United States Patent [19]

Ohiwa et al.

[11] 4,148,706

[45] Apr. 10, 1979

[54] ANODE PASTE FILLING APPARATUS FOR AN ALUMINUM ELECTROLYTIC CELL

[75] Inventors: Tadaaki Ohiwa; Yosio Kawase, both of Nagoya, Japan

[73] Assignee: Sumitomo Aluminium Smelting Co., Ltd., Osaka, Japan

[21] Appl. No.: 874,525

[22] Filed: Feb. 2, 1978

[30] Foreign Application Priority Data

Feb. 7, 1977 [JP] Japan ..... 52-12798

[51] Int. Cl.[2] ..... C25C 3/14; C25C 3/22

[52] U.S. Cl. ..... 204/245; 204/247

[58] Field of Search ..... 204/243 R–247, 204/67; 13/18

[56] References Cited

U.S. PATENT DOCUMENTS

| | | | |
|---|---|---|---|
| 1,757,695 | 6/1930 | Westly | 13/18 X |
| 2,475,452 | 7/1949 | Jouannet | 13/18 X |
| 2,680,143 | 6/1954 | Clegg et al. | 204/243 R |
| 4,021,318 | 5/1977 | Yano et al. | 204/67 |

FOREIGN PATENT DOCUMENTS

| | | | |
|---|---|---|---|
| 200769 | 3/1968 | U.S.S.R. | 204/243 R |
| 254107 | 3/1971 | U.S.S.R. | 204/245 |

*Primary Examiner*—John H. Mack
*Assistant Examiner*—D. R. Valentine
*Attorney, Agent, or Firm*—Stevens, Davis, Miller & Mosher

[57] ABSTRACT

An apparatus for filling an anode paste in an anode hole formed when an anode contact stud is pulled out from the anode of a vertical Soderberg aluminum electrolytic cell comprises horizontally moveable anode paste charging arm with an anode paste conveying means and a hopper for storing the anode paste and feeding the paste to the anode paste charging arm when required, the arm and the hopper being provided at a support movable along the electrolytic cell.

10 Claims, 4 Drawing Figures

ANODE PASTE FILLING APPARATUS FOR AN ALUMINUM ELECTROLYTIC CELL

The present invention relates to an apparatus for filling on anode paste in an anode hole formed when one anode contact stud is exchanged for another in a vertical Soderberg aluminum electrolytic cell.

In the vertical Soderberg aluminum electrolytic cell, steel anode contact studs are inserted into an anode from overhead, and the upper end of the anode contact stud is electrically connected to an anode bus bar to conduct an electric current. The lower end of the anode contact stud is bonded to the anode by baking in a baking layer of the anode, and moves down along with consumption of the anode in the process of the electrolytic reduction of aluminum from a molten cryolite bath containing dissolved alumina. When the anode contact stud moves down to some extent and its lower end approaches near to the lower surface of the anode, the anode contact stud is pulled out, and a fresh anode contact stud is positioned to a higher level of the anode. At that time, a hole remains at a location in the anode from which the anode contact stud has been pulled out. Since the fresh anode contact stud must be positioned to a higher level than before, an empty space is left under the lower end of the fresh anode contact stud and current can no longer pass, if the fresh anode contact stud is provided without disposing it within the hole. Thus, it is the normal expedient to fill a liquid, semi-molten or solid anode paste in the hole formed by the withdrawal of the anode contact stud, and provide a fresh anode contact stud on a level higher than before.

The anode paste for the aluminum electrolytic cell can be classified into two types: a paste showing a molten or semi-molten state at the upper part of the anode, and a paste failing to show a molten or semi-molten state at the upper part of the anode. Generally, the former type of the paste is usually used, mainly because a liquid, or semi-molten paste can automatically flow into a hole formed when the anode contact stud is withdrawn. Thus, it is not necessary in that case to fill anode paste by a special additional means into the hole formed by the withdrawal of the anode contact stud.

However, in the case of the former type of anode paste, segregation of anode paste components are liable to take place, and the anode often undergoes changes in composition in the vertical direction of the anode, forming a variety of layers, because such type of anode paste shows a molten or semi-molten state. Furthermore, an apparent specific gravity of the anode is low, and both deflective strength and compressive strength become low. Thus, anode troubles such as paste leakage and carbon dropout often appear when an anode contact stud is pulled out, and ultimately serious problem such as increases in electrode consumption and power consumption appear. Furthermore, such type of anode paste gives off volatile matters such as tar or pitch fumes from the upper unbaked surface of the anode, resulting in a considerable deterioration of the working atmosphere.

Recently, use of the latter anode paste showing no molten or semi-molten state at the upper part of the anode has been thus regarded as important, and has been employed. Improvements of process for producing aluminum, using such type of anode paste have been proposed (for example, see U.S. Pat. No. 4,021,318).

When anode paste of the type showing no molten or semi-molten state at the upper part of the anode is used, a hole is left as such after an anode contact stud is pulled out, and thus it is necessary to fill anode paste into the hole. It is customary to use an anode paste for the filling which has a somewhat lower softening point than solid briquette form anode paste accumulated at the upper part of the anode as a main raw material for the anode, and which normally can shown a molten or semi-molten state as soon as its filled into the anode hole. Usually, the paste is supplied in the form of powders or granules, but it can be in a liquid state.

However, no appropriate apparatus has been so far available for filling an anode hole with anode paste, and thus filling has been carried out by manual labor. The manual labor requires much labor power, and the work itself is very tedious.

As a result of extensive studies of apparatuses for promptly filling an anode paste into an anode hole formed by pulling out an anode contact stud from a vertical Soderberg aluminum electrolytic cell, the present inventors have devised an apparatus capable of satisfying said conditions by providing an anode paste charging arm and a hopper on a support movable along the electrolytic cell, the support having been so far employed for various purposes in the relevant field.

That is, the present invention provides an apparatus for filling a hole with an anode paste for a vertical Soderberg aluminum electrolytic cell, which comprises a horizontally moveable anode paste charging arm having an anode paste conveying means and for charging the anode paste into an anode hole formed when an anode contact stud is pulled out from the anode of aluminum electrolytic cell, and a hopper for storing the anode paste and feeding it to the anode paste charging arm when required, the anode paste charging arm and the hopper being provided on a support movable along the aluminum electrolytic cell.

The present invention will be described in detail, referring to the accompanying drawings.

Figure 1:
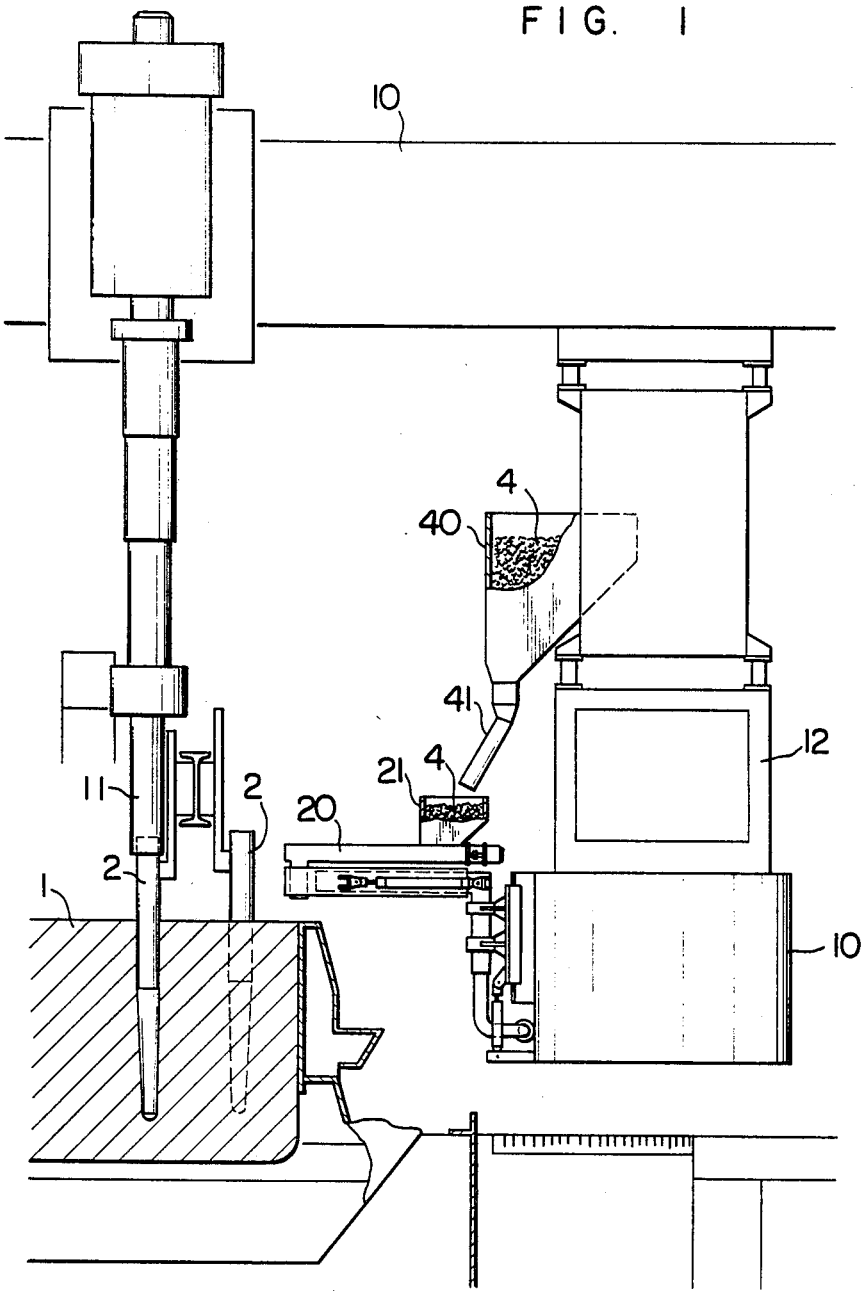
FIGS. 1 and 2 are schematic side views showing one embodiment of the present invention.
Figure 2:
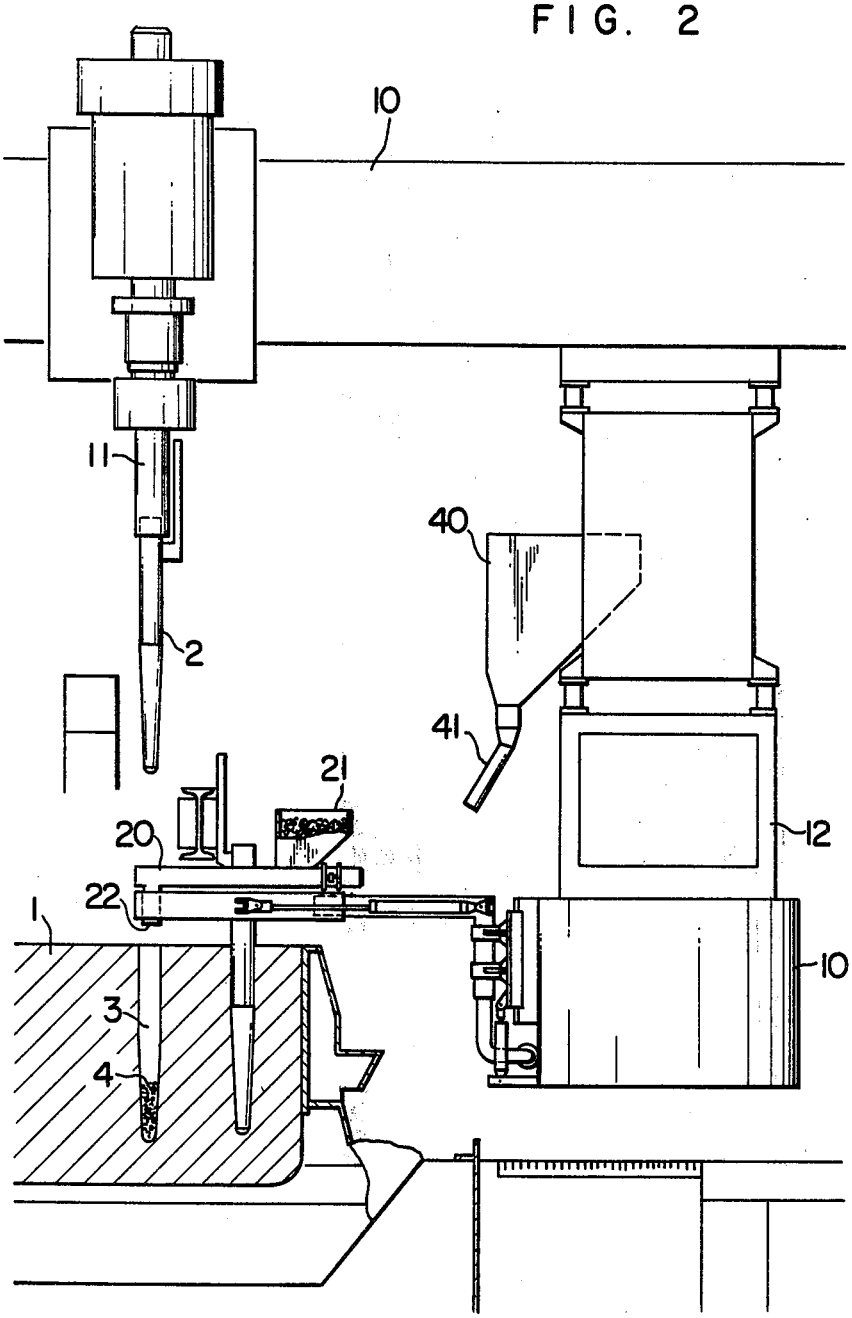

In FIG. 1, the present apparatus for filling a hole with anode paste is out of operation, that is, the anode contact stud is normally set. In FIG. 2, the present apparatus for filling a hole with anode paste is in operation, that is, one of the anode contact studs has been removed.

In FIG. 1, an anode contact stud 2 is plunged into anode 1 of the aluminum electrolytic cell, and the anode 1 moves down together with the anode contact stud 2, as the lower surface of the anode is consumed. When the anode contact stud moves down to some extent, a gripping means 11 grasps the anode contact stud 2 at its upper end to pull it out from the anode 1, as shown in FIG. 2. The withdrawn anode contact stud is exchanged with a fresh anode contact stud elsewhere, and then the gripping means 11 returns to its original position where the fresh anode contact stud is fixed on a level higher than before. The gripping means 11 is suspended from a support 10 movable along the electrolytic cell, and operated in an operating room 12 on the support 10.

In FIGS. 1 and 2, the support 10 is shown as an overhead travelling crane, but it can be constructed as a support travelling on the ground. For example, a vehicular carriage can be used as a support travelling on the ground. Two supports movable along the electrolytic cell can be provided; one for exchanging the anode contact stud, and another for filling a hole with anode paste according to the present invention, without providing the means for exchanging the anode contact stud. However, in such structure, the two supports may interfere with each other, making their operations complicated. Thus, a single support with the means for exchanging the anode contact stud as shown in FIGS. 1 and 2 is preferably employed.

According to the present invention, an anode paste charging arm 20 and a hopper 40 are provided on the support 10. A large amount of anode paste 4 stored in the hopper 40 is fed to a small hopper 21 on the anode paste charging arm 20 through a conduit 41 as shown in FIG. 1. When an anode contact stud is exchanged, that is, when the anode contact stud 2 is pulled out by the gripping means 11 on the support 10, the anode paste charging arm 20 is extended to the position of anode hole 3 formed by the withdrawal of the anode contact stud from the anode 1, and the anode paste 4 is charged into the anode hole 3 from an opening 22 at the tip end of the arm.

The anode paste charging arm 20 must have a horizontally travelling function to fill the anode paste into an anode hole at any position, and also must have a means conveying the anode paste to transport the anode paste in the small hopper 21 through the arm to the opening 22.

Figure 3:
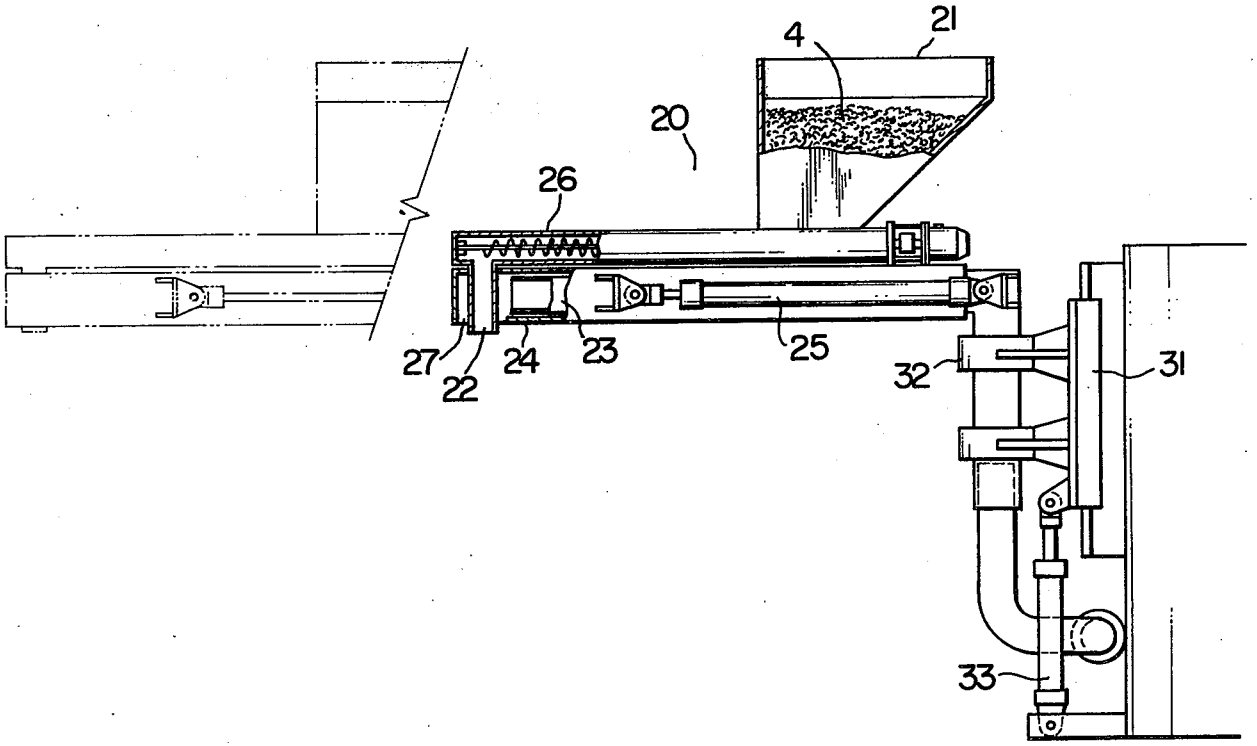
Fig. 3 is a side view showing an embodiment of anode paste charging arm according to the present invention.

In FIG. 3, a side view of one embodiment of the anode paste charging arm 20 is shown as comprising a guide 23 and a slide 24. The horizontally movable function can be readily provided by sliding the slide 24 on the guide 23 in a horizontal direction by a driver 25 such as an oil-hydraulic cylinder. In FIG. 3, one end of the driver 25 is fixed to the guide 23, and other end thereof is fixed to the slide 24, which can be horizontally moved by extension or contraction of the driver. An anode paste conveying means 26, such as a screw conveyer, is provided on the slide 24. In FIG. 3, the slide 24 is extended to the position of the anode hole to be filled with the anode paste, and the anode paste conveying means 26 is actuated, whereby the anode paste 4 in the small hopper 21 is charged into the anode hole from the opening 22 provided at the tip end of the slide 24. An extended state is shown at the left side of FIG. 3 by broken lines.

In addition to the screw conveyor, a belt conveyor, a vibration conveyor, or the like can be employed as the anode paste conveying means.

It is also possible to horizontally move both arm 20 and hopper 40 as an integrated unit, in addition to the embodiment of the guide and the slide shown in FIG. 3.

The amount of anode paste filled in the anode hole corresponds to a difference between the level of the old anode contact stud and that of the fresh anode contact stud. Thus, it is preferable to provide a rated charging means for charging a definite amount of the anode paste into the hole by actuating the means for conveying the anode paste for a definite period of time by means of a timer, etc. As the rated charging means, a method of actuating a rotary value for a definite period of time, a method for supplying a measured volume of the anode paste with a definite volume measuring means, etc. can be employed in addition thereto.

Since the anode hole usually has an inside temperature as high as about 500° to 900° C, volatile matters, for example, smoke-like fumes, are generated instantaneously when the anode paste is filled into the anode hole in the manner described above. Thus, it is preferable to provide a means for sucking the volatile matters on the anode paste charging arm to remove the fumes by suction. For example, in the case of employing the arm shown in FIG. 3, both the guide 23 and the slide 24 are made hollow, and an opening 27 of the slide is made to extend to the position of the anode hole together with the opening 22 for charging the anode paste. The volatile matters can be sucked into the opening 27 by putting the hollow insides of the guide and the slide under a negative pressure. The volatile matters thus sucked can be collected by passing them through a cyclone, a water washing unit, etc. Such collectors are described in detail in Japanese Laid-Open Patent Application Specification No. 61106/77.

Preferably, the anode paste charging arm has either a rotating function or a vertically extendable function, or both. The rotating function can be given by supporting the anode paste charging arm 20 on a frame 31 through mounting devices 32, and making the arm rotatable at the mounting devices 32, as shown in FIG. 3.

The vertically extendable function can be given by providing an actuator 33 such as an oil-hydraulic cylinder under the frame 31 and making the frame 31 vertically move by horizontal extension or contraction of the actuator, as shown in FIG. 3.

Figure 4:
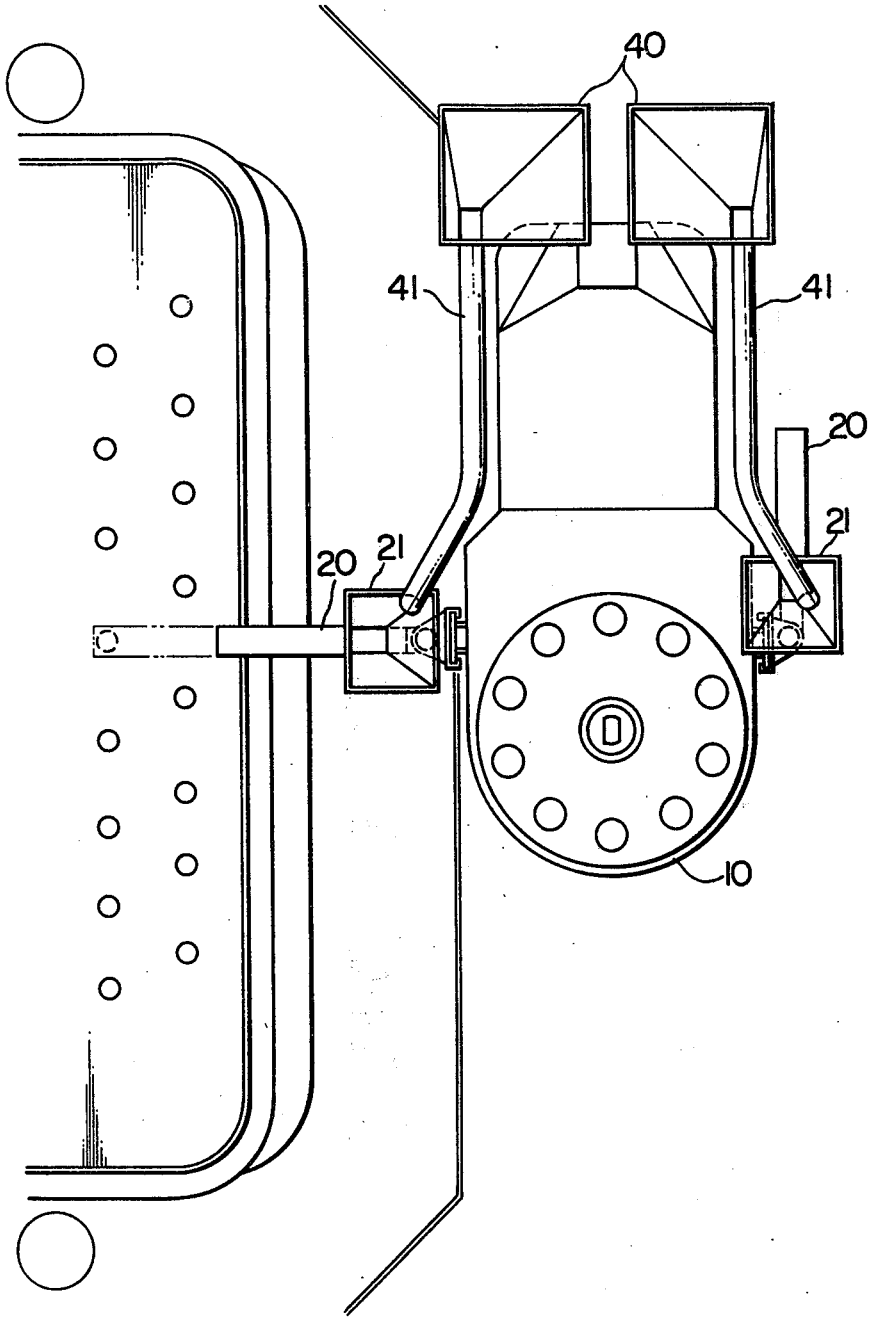
FIG. 4 is a plan view showing one embodiment of a layout of a hopper and an anode paste charging arm according to the present invention.

In FIG. 4, an embodiment is shown employing anode paste charging arms 20 and hoppers 40 at both sides of the support 10 with the anode paste charging arm 20 at the right side being placed at the side of the support 10 by a rotating movement. When the arm is to be actuated, the anode paste charging arm 20 is rotated to the direction of the electrolytic cell, as shown at the left side of FIG. 4, and extended to the position illustrated by the broken lines. Thus, the rotating function is effective for placing the anode paste charging arm 20 to the side of the support 10 when not used. The vertically extendable function is effective for vertically moving the anode paste charging arm in accordance with the vertical level of the anode. Of course, the present apparatus can be constructed without the rotating function and horizontally extendable function.

The hopper 40 can be mounted at a position on any level of the support 10. For example, the hopper can be fixed just above the anode paste charging arm and can be integrated with the arm. However, mounting of a larger hopper at that position will create an obstacle to an operator's view from his operating position, and thus it is preferable to mount the hopper at an end or side of the support 10 or at another position creating no obstacle to the operator's view.

In the FIG. 4 embodiment, the hoppers 40 are mounted at the end of the support 10. Even if the hoppers 40 are provided at a position far from the anode paste charging arms 20, the desired filling can be attained by connecting the arms to the hoppers by conduits 41. The anode paste is transported to the charging arms 20 through the conduits 41 by a suitable conveying means such as screw conveyers, etc., or merely by force of gravity.

In FIG. 4, small hoppers 21 provided at the anode paste charging arms 20 are supplied with anode paste through the conduits 41, but the conduits 41 can be made flexible and may be directly connected to the anode paste charging arms 20.

The anode paste is supplied to the hoppers 40 at an appropriate time by a distributor, a conveying means, etc.

According to the present invention, an anode paste can be filled into an anode hole with ease without manual labor by providing an anode paste charging arm and a hopper on a support movable along an electrolytic cell an normally used for various purposes in the relevant field, for example, to support a device used for exchanging an anode contact stud. Thus the present invention can easily be incorporated on existing apparatus to readily achieve the desired objective of filling an anode hole with anode paste.

What is claimed is:

1. An apparatus for filling an anode hole in a vertical Soderberg aluminum electrolytic cell with anode paste comprising an anode paste charging arm for charging anode paste into a hole formed upon removal of an anode stud from the anode of said aluminum electrolytic cell, said arm comprising an anode paste input, a paste conveying means, a paste output, a horizontally disposed guide an associated slide cooperating therewith, and means for horizontally moving said slide along said guide to position said paste output at a desired location;

a hopper for storing anode paste; and, means for feeding stored anode paste from said hopper to said anode paste input, said anode paste charging arm, said hopper and said means for feeding being provided on a support movable along said aluminum electrolytic cell.

2. An apparatus according to claim 1, wherein said support movable along said aluminum electrolytic cell is an overhead travelling crane.

3. An apparatus according to claim 1, wherein said support movable along said aluminum electrolytic cell is provided with a means for exchanging one anode contact stud for another.

4. An apparatus according to claim 1, wherein said anode paste charging arm and said hopper moves horizontally as an integrated unit upon horizontal movement of said slider.

5. An apparatus according to claim 1, wherein the anode paste charging arm is provided with a rated charging means.

6. An apparatus according to claim 5, wherein the rate charging means is provided by a means actuating the anode paste conveying means for a definite period of time.

7. An apparatus according to claim 1, wherein the anode paste charging arm is provided with a means for sucking volatile matters away from said aluminum electrolytic cell.

8. An apparatus according to claim 7, wherein the anode paste charging arm is comprised of a hollow guide and a hollow slide with the hollow insides of the guide and the slide being put under a negative pressure, thereby providing said means for sucking away volatile matters.

9. An apparatus according to claim 1, wherein the anode paste charging arm is provided with rotary movement or a horizontally extendable movement or both.

10. An apparatus according to claim 1, wherein said means for feeding is a conduit.

* * * * *